US009630221B2

(12) United States Patent
Brummer

(10) Patent No.: US 9,630,221 B2
(45) Date of Patent: Apr. 25, 2017

(54) TOILET CLOG CLEARANCE DEVICE

(71) Applicant: Toby Brummer, Granite Bay, CA (US)

(72) Inventor: Toby Brummer, Granite Bay, CA (US)

( * ) Notice: Subject to any disclaimer, the term of this patent is extended or adjusted under 35 U.S.C. 154(b) by 28 days.

(21) Appl. No.: 13/998,700

(22) Filed: Nov. 26, 2013

(65) Prior Publication Data

US 2015/0143623 A1 May 28, 2015

(51) Int. Cl.

| | |
|---|---|
| ***E03C 1/302*** | (2006.01) |
| ***B08B 9/02*** | (2006.01) |
| ***B08B 9/027*** | (2006.01) |
| ***E03C 1/30*** | (2006.01) |
| *E03D 9/00* | (2006.01) |
| *A47K 11/10* | (2006.01) |

(52) U.S. Cl.

CPC ..... *B08B 9/02* (2013.01); *B08B 9/027* (2013.01); *E03C 1/30* (2013.01); *A47K 11/10* (2013.01); *E03D 9/00* (2013.01)

(58) Field of Classification Search

CPC ..... A47K 11/10; B08B 9/02; B08B 9/027; B08B 9/04

USPC ..... 4/255.01, 255.11, 255.12; 15/104.31, 15/104.16, 211, 104.15

See application file for complete search history.

(56) References Cited

U.S. PATENT DOCUMENTS

| | | | | | |
|---|---|---|---|---|---|
| 265,319 | A * | 10/1882 | Howell | 15/104.16 | |
| 566,041 | A * | 8/1896 | Warner | F41A 29/02 15/104.19 | |
| 1,586,337 | A * | 5/1926 | Stockwell | 15/104.31 | |
| 2,430,164 | A * | 11/1947 | Dew, Jr. | 15/104.165 | |
| 2,719,999 | A * | 10/1955 | Hardin | 15/210.1 | |
| 3,231,921 | A * | 2/1966 | Cuervo | 15/244.1 | |
| 3,319,281 | A * | 5/1967 | Montgomery | 15/244.1 | |
| 4,358,861 | A * | 11/1982 | Sard | 4/255.03 | |
| 5,214,820 | A * | 6/1993 | Shumway et al. | 15/118 | |
| 5,548,862 | A * | 8/1996 | Curtis | 15/118 | |
| 5,755,002 | A * | 5/1998 | Lacy | 15/104.31 | |
| 6,163,895 | A * | 12/2000 | Davenport | 4/255.06 | |
| 6,779,202 | B1 * | 8/2004 | Alldredge | 4/255.02 | |
| 2002/0082109 | A1 * | 6/2002 | Wang | 473/300 | |
| 2008/0066222 | A1 * | 3/2008 | Mooney | 4/295 | |
| 2008/0250590 | A1 * | 10/2008 | Trefethren et al. | 15/145 | |

* cited by examiner

*Primary Examiner* — Erin Deery
(74) *Attorney, Agent, or Firm* — Mark C Jacobs

(57) ABSTRACT

This toilet unclogging tool has a handle attached at the proximal end of, a shaft, either straight or bent, and a bullet shaped head portion, attached at the distal end of the shaft, which head is made of a semi-rigid material such as closed cell polyethylene foam. The head has a series of grooves, usually four of a V-shape, along the length thereof to permit fluid to pass there through when one attempts to push a blockage forward over the trap of a toilet. A rigid cap having a flat face is disposed into the forward end of the head to enhance the ability of the device to push a clog without deforming the head.

15 Claims, 2 Drawing Sheets

TOILET CLOG CLEARANCE DEVICE

FIELD OF INVENTION

This invention relates to devices used for forcing toilet paper and other materials that clog a toilet forward to the drain to unclog the toilet.

BACKGROUND OF THE INVENTION

People of all ages, from little toddlers to senior citizens have from time to time clogged toilets by placing non-biodegradable items in the toilet and then attempting to flush the toiler. These items can range from excess toilet paper, to paper towels to toy soldiers, to Lego® pieces, to sanitary napkins, to cell phones, and every other imaginable item.

The most common tools used for unclogging a toilet are a snake, which requires a bit of expertise and which tool is usually not found in the household, and a plunger which is a rubber deformable cup mounted on a handle, which cup fits over the throat of the toilet trap. A partial vacuum is formed so that the change in pressure upon release of the cup over the throat of the trap will force the blockage up and over the trap. The plunger is messy spills water or urine or feces fluid on the floor, perhaps on the clothing of the user, and the tool is not fun to use.

Prior art tools that are less common include the "Splunger", a combination tool, disclosed and claimed in US Patent Publication 2006/0260077 of Wilson, which is quite complex in design.

Thus there is a need for an easy to use tool which will force the blockage material up and over the trap such that the blocking material can fall into the waste drain and thereby allowing the toilet to function properly, rather than backing up and spilling water into the bathroom. This device satisfies that need.

SUMMARY OF THE INVENTION

The tool of this invention has a handle, a shaft, either straight or bent, and a bullet shaped head portion, attached at the distal end of the shaft, which head is made of a semi-rigid material such as closed cell polyethylene foam, the head having a series of grooves along the length thereof to permit fluid to pass there through.

It is a first object to provide an easy to use device for unclogging a toilet.

It is a second object to provide a device that does not splatter water, feces, or urine to the floor of the bathroom or on the clothing of the user, when unclogging a toilet.

It is a third object to provide an unclogger that is light in weight and as such can be used by persons of all ages.

It is a fourth object to provide a device that can be easily hung on a hook for storage until the occasion when needed.

Other objects of the invention will in part be obvious and will in part appear hereinafter.

The invention accordingly comprises the device possessing the construction, combination of elements and arrangement of parts, which are exemplified in the following detailed disclosure, and the cope of the application of which will be indicated in the claims.

For a fuller understanding of the nature and objects of the invention, reference should be made to the following detailed description taken in conjunction with the accompanying drawings.

DESCRIPTION OF THE PREFERRED EMBODIMENT

Figure 1:
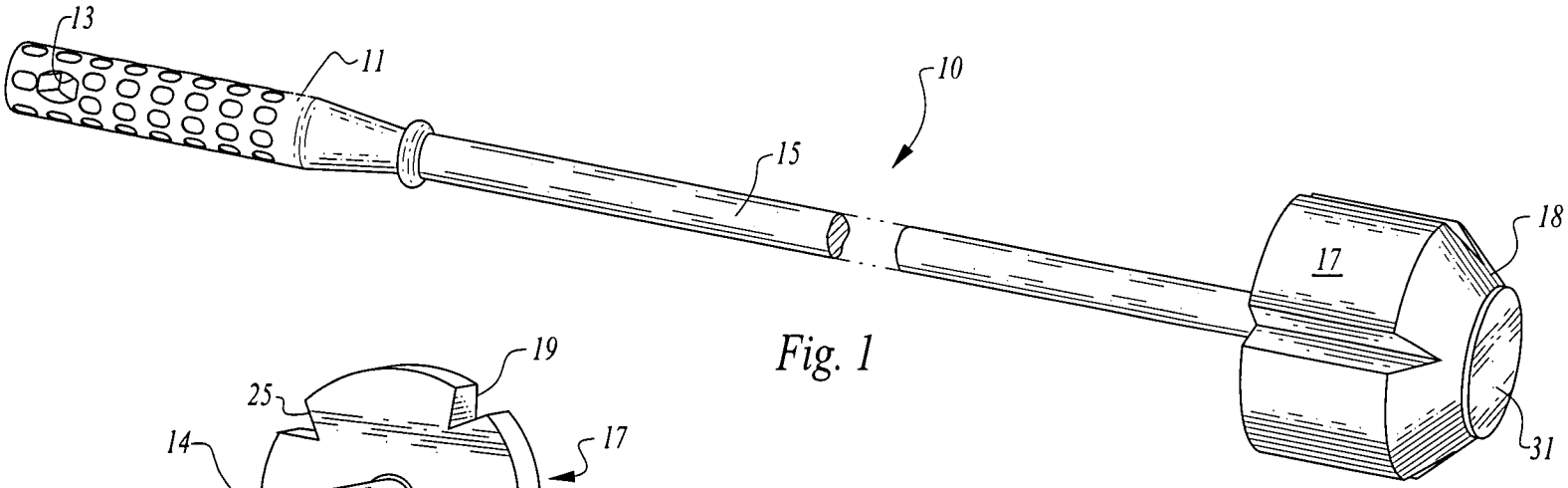
FIG. 1 is top perspective view of the device of this invention's first embodiment.

Let us turn first to FIG. 1 which is a perspective view of the first embodiment. The device 10 is seen to have 3 portions, a handle 11 which has a distal and a proximal end, an elongated shaft second portion 15 which also has distal and proximal ends and an operative head portion 17 formed of a semi-rigid bullet shaped section 18, attached at its rear to the distal end of the shaft and a rigid cap disposed in the forward end of the bullet shaped section to inhibit deformation of the foam head. The external surface of the cap is generally flat, but may be slightly convex.

The handle portion 11 is an elongated rod of a diameter of about 1 inch for easy gripping by young and old alike, and the handle has at its proximal end, a hole either round of about ¼ inch diameter or an elongated slot of about ¼ by ⅝ths inch to permit the unit to be easily hung on a hook in storage awaiting the infrequent occasion when use is required. The handle may have a rubber coating thereon to enhance grippability. Recesses spaced apart within the rubber, to create different elevations therein, further enhance grippability of the handle.

The second portion 15 is the shaft which can have an overall length of about 12 to 19 inches, though longer shafts up to 24 inches are also contemplated. The shaft 15 is preferably of a smaller diameter than the handle 11, and may be tubular or a solid rod, depending upon the material employed. While metal such as aluminum or stainless steel may be employed as well as painted wood, the use of an injection molded plastic portion is believed to be the most cost effective mode of manufacture.

It is to be noted that the handle portion may be attached at its distal end to the proximal end of a separate shaft portion or the two portions may be formed as a unitary member. By conventional manufacturing techniques.

Detailed discussion of the operative head portion 17, will be set out infra.

Figure 2:
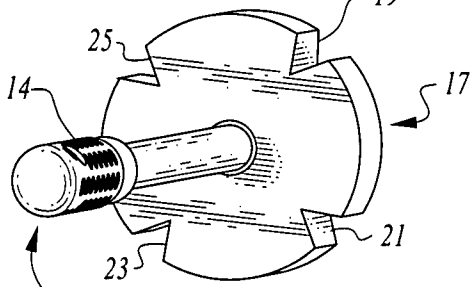
FIG. 2 is a rear perspective view of this invention's first embodiment.

The discussion now moves to FIG. 2, a rear perspective view of the first embodiment of this device. As can be seen in this view the handle 11 can have a series of recesses 14 therein to enhance grippability of the handle. The handle attached to the shaft is seen attached to the head 17. At 90 degree intervals the V-shaped flutes or grooves 19,21,23, & 25 are seen. While seen here in the 12, 3, 6, and 9 o'clock positions, the physical location of the grooves during periods of use of the device is irrelevant.

Figure 3:
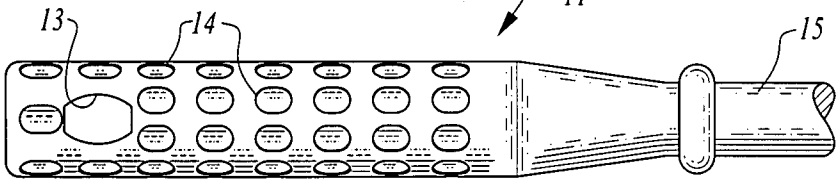
FIG. 3 is a closeup plan view of a portion of the handle thereof.

FIG. 3 is a closeup view of the handle portion 15 showing the recesses 14 which enhance grippability of the handle, as well as the slot 13 used for hanging the device 10 on a hook.

Figure 4:
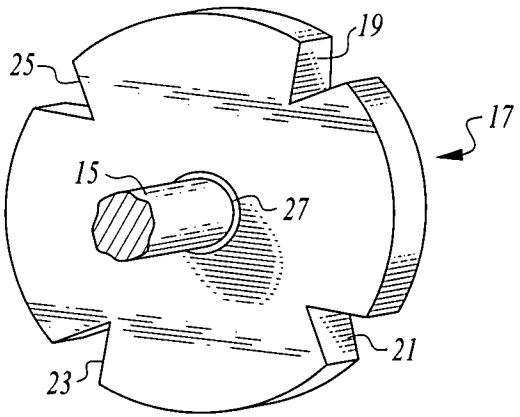
FIG. 4 is a closeup rear view of the unclogger portion of embodiment one.

FIG. 4 is a closeup rear view of the head 17's operative portion and a part of the shaft. The head is preferably formed of a semi-rigid material which will deform only slightly and which will not absorb water or other fluid from within the toilet bowl. A preferred material employed by applicant is closed cell polyethylene foam having a density of about 4.0 pounds per cubic foot and 0.02 lbs/sq ft of water absorption. The grooves or flutes, 4 in number, seen at 90 degree intervals, can be cut full length by any conventional technique, be it saw, hot blade, or knife. While 4 grooves are shown more grooves such as 5 or 6 spaced at 72 degrees apart or 60 degrees apart are also contemplated.

The distal end of the shaft may be either threaded or unthreaded prior to engagement with the head 15 by insertion into bore 27 at the base of the bullet shaped head. See FIG. 1. It is believed that difficulty will be had in trying to cut threads into a foam member and the risk of breaking cell walls, could be damaging to the ability of the head to act as intended. Thus the end of the shaft is coated with a suitable adhesive such as GOOP®, a general purpose industrial and construction adhesive. It is within the skill of the art to determine other suitable general purpose adhesives. Among these, mention may be made of Gorilla glue, available at any home improvement big box store.

Figure 5:
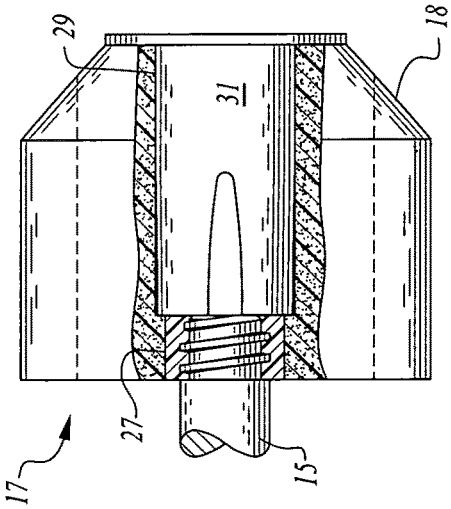
FIG. 5 is a closeup cutaway view of the unclogger head portion of this device and part of the shaft.

FIG. 5 is the next figure for discussion. This figure is a closeup cutaway view of the head portion of this invention. Head 17 is seen to have 2 bores therein, the proximal bore 27 is sized to frictionally receive the end of the shaft 15, with a suitable adhesive thereon. A second bore of about one inch diameter, from the distal end inward 29 is sized to receive cap 31 therein. The incline is about ⅞ths inch in length.

Figure 6:
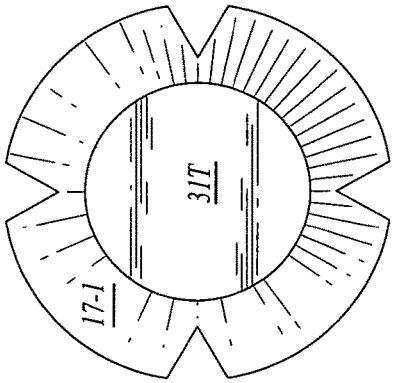
FIG. 6 is a top plan view of the operative portion of this device.

FIG. 6 is a top plan view of the bullet shaped head 17, and showing the top 31T of the cap 31. The incline, 17-1 of the front surface of the head can range from 45 degrees to about 48 degrees to the horizontal.

Figure 7:
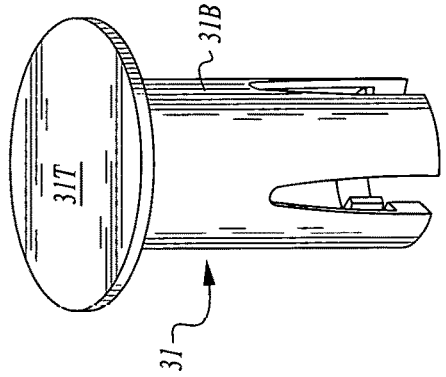
FIG. 7 is a perspective view of the cap which forms part of this invention.
Figure 8:
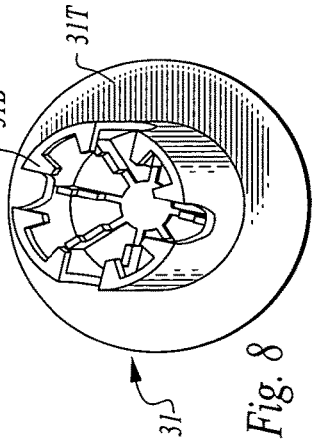
FIG. 8 is a rear perspective view of the cap forming part of this invention.

In FIG. 7, the entire cap 31 is seen. The top of the cap 31T is seen to be of a greater diameter tan the body, 31B. While the diameter of the top 31T is about 1.4 inches in diameter, the body of the cap is only 1.0 inches, such that with a suitable adhesive the cap will be retained in bore 29 which should be just slightly greater in diameter such as 1.16 inches than the diameter of the body of the cap. The two diameters of cap top and cap body can e seen in FIG. 8.

Figure 9:
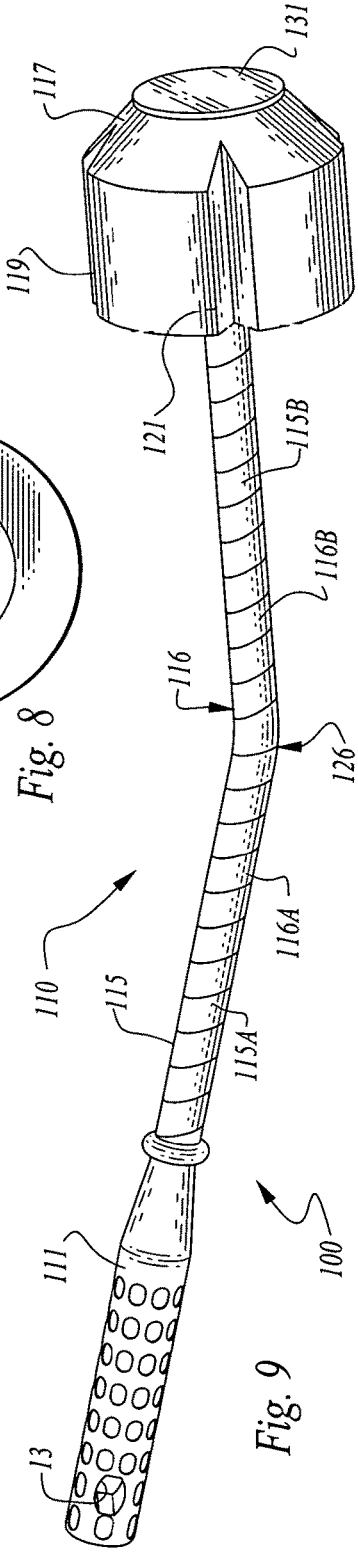
FIG. 9 is a perspective view of a second embodiment of this invention.

In FIG. 9 the second embodiment of this invention can be seen, and which is designated 100 with all parts being in the 100 series, wherein like parts retain the same last two digits. The head portion 117 of this embodiment is the same including the V-grooves as in the first embodiment and as such no further discussion is needed. The handle portion 111, and the shaft 115 however are quite different however.

In the second embodiment, 110, the handle 111, instead of having the recesses therein, is tape wrapped much like as is seen on a tennis racket. Note designator 116, the tape wrap such as electrical tape which is a vinyl film with adhesive on one side. The slot 13 for hanging the device on a nail or hook is not found n this embodiment.

The shaft 115 is seen to be bent at any where from 40% along the length thereof to 60 percent along the length thereof, at an angle of between 15 and 17.5 degrees upwardly to render the movement of the user's hand easier in that the hand is in a higher position relative to the floor of the bathroom, using this shaft. This allows the user to lower his/her arm in a fulcrum like manner, to raise the head 117 toward the bend in a conventional toilet trap to push the clog along the path. The shaft sections are 115A and 115B.

It should be noted that either handle 11 or handle 111 can be substituted for the other and that embodiments with a straight or canted (bent) shaft with either handle are contemplated. Also the employment of a slot in the handle of the second embodiment is also within the scope of this invention.

While closed cell polyethylene foam has been mentioned, any semi-rigid closed cell polymeric foam can be employed for the material of the head such as polyurethane closed cell foam. The cap, 131, and 31 is made of any high impact plastic such as styrene.

A typical unit will have a head approximately three inches long by three inches wide with V-grooves of about ¼ inch to ½ inch wide. The shaft can vary from 12 to 18 inches long by about ½ to 1 inch in diameter, with a handle of six to 8 inches long and of a slightly larger diameter than the shaft for ease of use. The cap in the nose of the bullet shaped head should be about 1.5 inches in diameter.

Since certain changes may be made in the described devices without departing from the scope of the invention herein involved, it is intended that all matter contained in the above description and shown in the accompanying drawings shall be interpreted as illustrative and not in a limiting sense.

I claim:

1. A device for unclogging a toilet comprising:

a head portion with a cylindrical rear section and a frustro-conical front section, said head portion connected to one end of a shaft portion, a handle connected at an other end of the shaft portion, said head portion further comprising a series of longitudinal grooves therein which permit rearward passage of fluid through said longitudinal grooves when a user pushes forwardly against a clog, so that the clog will pass through a toilet trap to thereby unclog the toilet, the frustro-conical front section of the head portion additionally comprising a rigid cap having a disk first portion which is flat and circular and attached to a hollow second portion, the hollow second portion being received within the interior of the frustro-conical front section and cylindrical rear section of the head portion, said cap hollow second portion having a lesser diameter than the disk first portion, and wherein the disk first portion entirely covers a circular, flat forward end of the frustro-conical front section, the rigid cap preventing deformation of the head portion.

2. The device of claim 1, wherein said head portion is made of semi-rigid, polymeric foam.

3. The device of claim 1, wherein the head portion is made of semi-rigid, closed cell, polyethylene foam and the shaft is straight.

4. The device of claim 3, wherein the handle is tapered and has grippability enhancing means thereon and the series of longitudinal grooves in the head portion extend from the cylindrical rear section into the frustro-conical front section.

5. The device of claim 4, wherein the device has a slot therein for hanging the device on a nail or hook.

6. The device of claim 4, wherein the grippability enhancing means is a vinyl tape wrap.

7. The device of claim 4, wherein the grippability enhancing means is a rubber coating.

8. The device of claim 1, wherein the head portion is made of semi-rigid closed cell, polyethylene foam and the shaft is bent along a length thereof to an angle greater than 90 degrees.

9. The device of claim 8, wherein the handle has grippability enhancing means.

10. The device of claim 8, wherein said handle is of a diameter greater than a diameter of the shaft.

11. A device for unclogging a toilet comprising:

a head portion with a cylindrical rear section and a frustro-conical front section, a shaft portion having a first end connected at the rear section of said head portion, a handle connected at a second end of the shaft portion, said head portion having a series of longitudinal grooves therein which permit rearward passage of fluid through said longitudinal grooves when a user urges forwardly against a clog to thereby unclog the toilet, wherein the head portion is made of semi-rigid, closed cell, polymeric foam, and wherein the device has a rigid cap disposed on a flat, circular forward end of the frustro-conical front section of the head portion to prevent deformation of the head portion, said cap having a disk first portion which is flat and circular and attached to a hollow second portion, the hollow second portion being received within the interior of the frustro-conical front section and cylindrical rear section of the head portion, and wherein the disk first portion entirely covers the forward end of the frustro-conical front section, and further wherein the handle has a grippability enhancing means thereon.

12. The device of claim 11, wherein the head portion, the shaft, and the handle are linearly aligned.

13. The device of claim 11, wherein the foam is polyethylene, and the grippability enhancing means is a rubber coating, and the longitudinal grooves are V-shaped.

14. The device of claim 11, further the grippability enhancing means is a vinyl tape wrap.

15. The device of claim 11, wherein the shaft is of a first diameter and the handle is of a diameter great than the diameter of the shaft.

* * * * *